US006264442B1

(12) United States Patent
Foss

(10) Patent No.: US 6,264,442 B1
(45) Date of Patent: Jul. 24, 2001

(54) HIGH VOLUME POSITIVE DISPLACEMENT PUMP WITH GEAR DRIVEN ROTARY VALVES

(75) Inventor: John F. Foss, Okemos, MI (US)

(73) Assignee: Board of Trustees Operating Michigan State University, East Lansing, MI (US)

( * ) Notice: Subject to any disclaimer, the term of this patent is extended or adjusted under 35 U.S.C. 154(b) by 0 days.

(21) Appl. No.: 09/353,098

(22) Filed: Jul. 14, 1999

Related U.S. Application Data

(63) Continuation-in-part of application No. 09/239,120, filed on Jan. 28, 1999, now Pat. No. 6,200,111.

(51) Int. Cl.[7] ..... F04B 7/00
(52) U.S. Cl. ..... 417/515; 417/531; 417/539
(58) Field of Search ..... 417/515, 531, 417/539; 137/624.13

(56) References Cited

U.S. PATENT DOCUMENTS 3,875,810 * 4/1975 Paramonoff ..... 137/624.13
3,981,620 * 9/1976 Abrahams et al. ..... 417/539
4,007,725 * 2/1977 Weaver ..... 123/190 A
4,244,338 * 1/1981 Rassey ..... 123/190 A
4,773,364 * 9/1988 Hansen et al. ..... 123/190 E
5,410,996 * 5/1995 Baird ..... 123/190.2
5,706,775 * 1/1998 Schweter et al. ..... 123/190.2
5,720,241 * 2/1998 Gail ..... 123/43
5,993,654 * 11/1999 Black ..... 417/44.2

* cited by examiner

*Primary Examiner*—Cheryl J. Tyler
(74) *Attorney, Agent, or Firm*—Brinks Hofer Gilson & Lione

(57) ABSTRACT

A positive displacement pump for gases includes a pair of pistons operating out of phase. Each of the pistons is associated with a plurality of rotary inlet valves disposed along the sidewalls of the piston cylinders. A rotary outlet valve is also associated with each piston and includes a rotating valve body disposed transversely across the cylinder head and which rotates in synchronism to open a through, radial port in the member in timed relationship to the piston travel. The positive displacement pump finds particular application heating, cooling and ventilating applications.

19 Claims, 5 Drawing Sheets

HIGH VOLUME POSITIVE DISPLACEMENT PUMP WITH GEAR DRIVEN ROTARY VALVES

CROSS REFERENCE TO CO-PENDING APPLICATION

This patent application is a continuation-in-part of U.S. Pat. Ser. No. 09/239,120 filed Jan. 28, 1999, now U.S. Pat. No. 6,200,111 granted Mar. 13, 2001 which is hereby incorporated by reference.

BACKGROUND OF THE INVENTION

The invention relates generally to positive displacement pumps for gases and more specifically to a positive displacement pump having a pair of pistons operating out of phase and specially configured rotary inlet and outlet valves.

Positive displacement pumps for liquids and gases typically include one or more piston and cylinder assemblies and associated inlet and outlet valves which control the flow of pumped fluid into and out of the cylinders. Such pumps are typically capable of relatively high pressure rise operation. A drawback of such positive displacement pumps is that both the inflow and outflow are distinctly pulsatile in character and, especially with high pressure pumps, the flow rates are generally relatively small.

Furthermore, the ability to adjust pressure and flow rates with such pumps can be problematic. Typically, of course, flow rates may be adjusted simply by reducing the speed of the pump. However, such a speed reduction to reduce output flow rate is typically accompanied by a reduction in the output pressure as well.

It is apparent from the foregoing that a positive displacement pump which addresses the problems of output pulsation and controllable flow characteristics would represent an improvement over currently available devices.

SUMMARY OF THE INVENTION

The present invention is directed to a high volume, positive displacement pump which provides a flow rate having temporal fluctuations which are a smaller fraction of the time mean value than those of conventional positive displacement pumps and is a higher flow rate, smaller pressure rise device than conventional positive displacement pumps.

A positive displacement pump for heating, cooling and ventilating applications includes a pair of pistons operating out of phase which provide pumped fluid to a common output. Each of the pistons is associated with an inlet valve array which includes a plurality of rotary inlet valves arranged along opposed, preferably vertical, sidewalls of the cylinders to control the influx of fluid. A rotary outlet valve is also associated with each piston and includes a rotating valve body disposed transversely across the cylinder head which rotates in synchronism to open a through, radial port in the valve body in timed relationship to the piston travel. A drive motor rotates a crankshaft and cams which control actuation of the inlet and outlet valves. The phase relationship between the operation of the inlet and outlet valves and the respective pistons is fixed. The positive displacement pump finds particular application in heating, ventilating and air conditioning (HVAC) apparatus and applications.

Thus it is an object of the present invention to provide a high volume, positive displacement pump.

It is a further object of the present invention to provide a positive displacement pump suitable for applications in HVAC apparatus.

It is a still further object of the present invention to provide a positive displacement pump wherein rotary inlet and outlet valves operate in synchronism with reciprocating pistons.

It is a still further object of the present invention to provide a positive displacement pump wherein the phase relationships of the inlet and outlet valves are fixed relative to the reciprocating pistons.

Further objects and advantages of the present invention will become apparent by reference to the following description of the preferred and alternate embodiments and appended drawings wherein like reference numbers refer to the same component, element or feature.

DESCRIPTION OF THE PREFERRED EMBODIMENT

Figure 1:
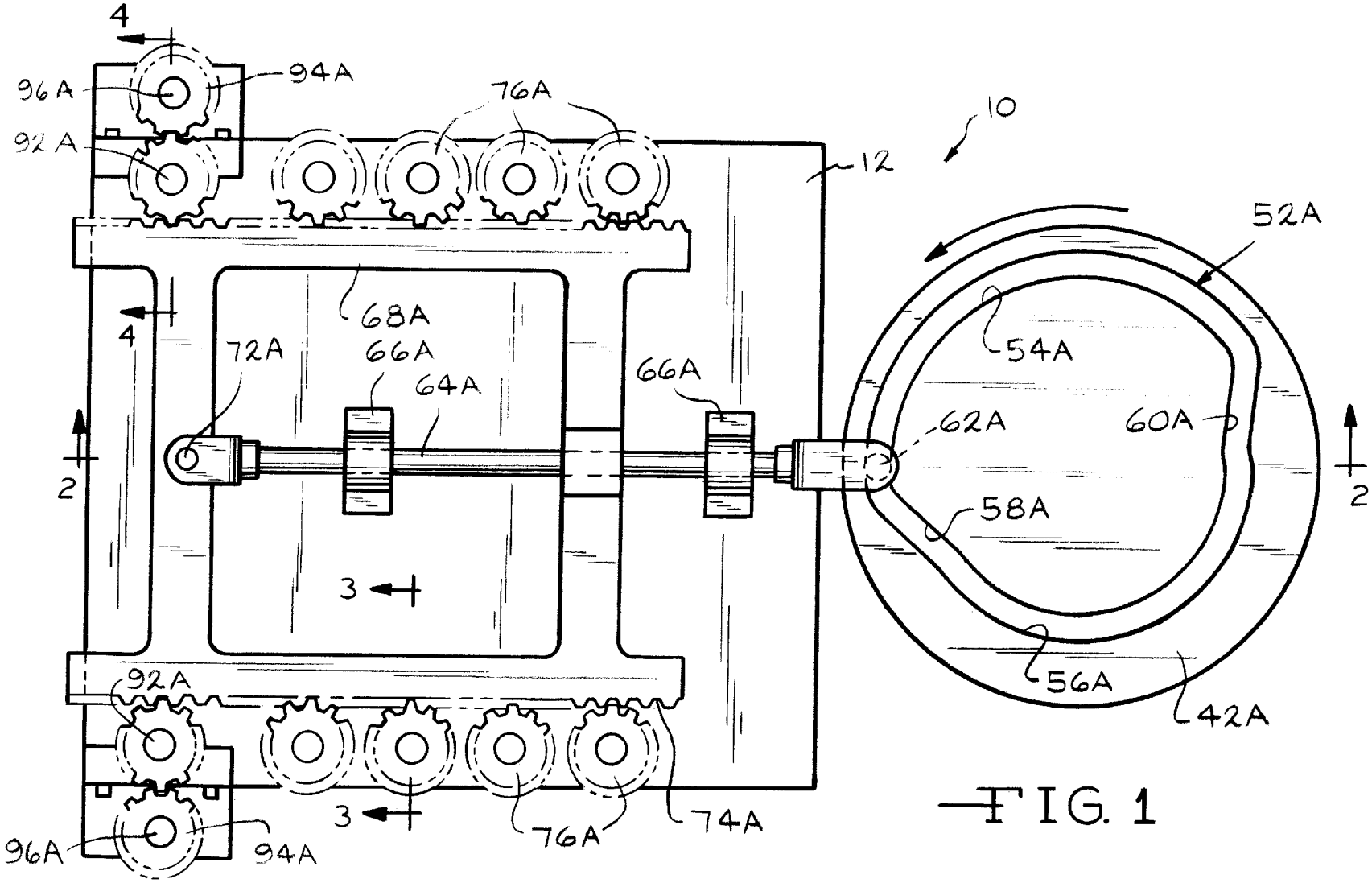
FIG. 1 is a top, plan view of a positive displacement pump according to the present invention.
Figure 2:
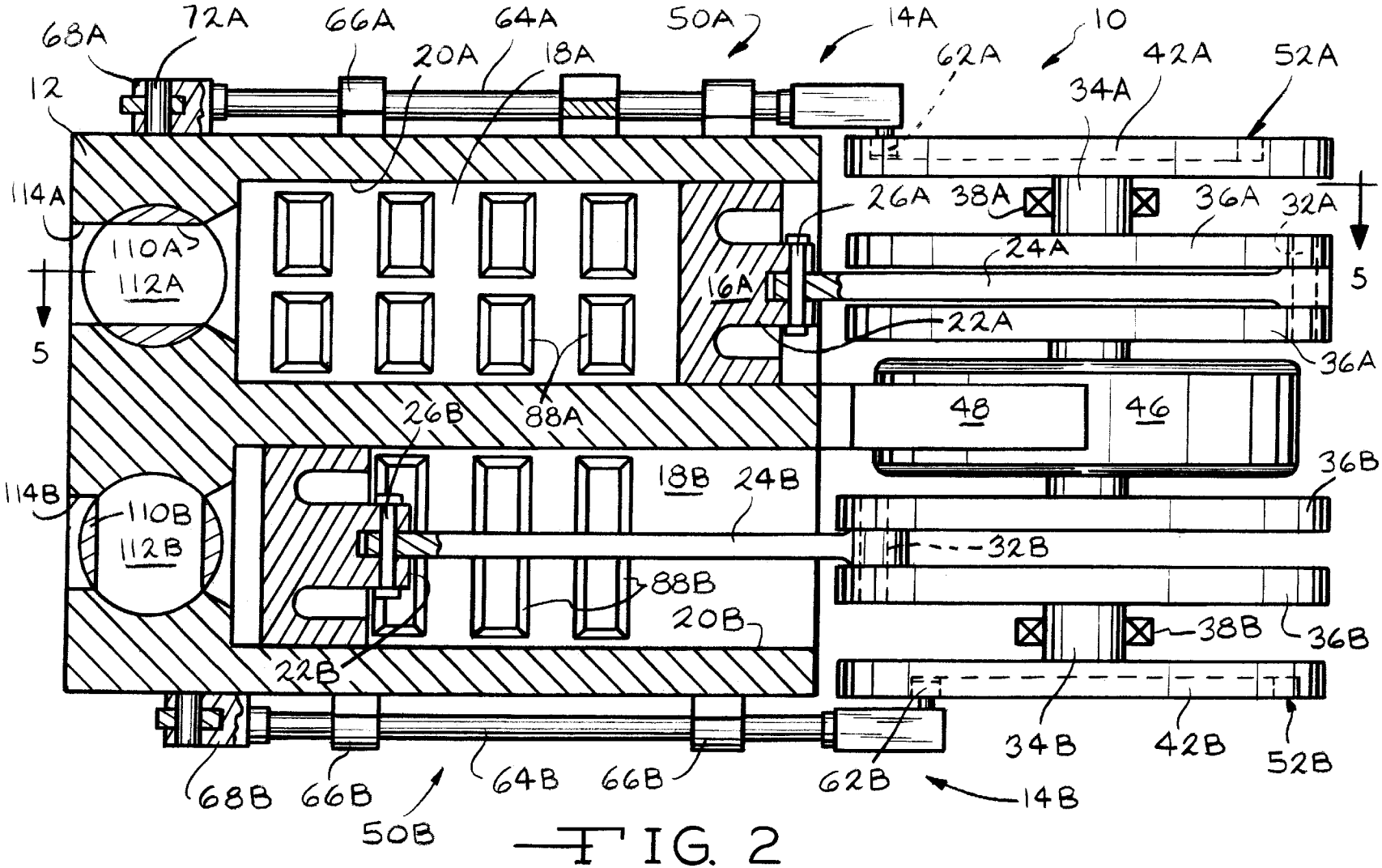
FIG. 2 is a side, elevational view in partial section of a positive displacement pump according to the present invention taken along line 2—2 of FIG. 1.

Referring now FIGS. 1 and 2, a high volume, positive displacement pump according to the present invention is illustrated and generally designated by the reference number 10. The positive displacement pump 10 includes a housing 12 which is preferably cast metal and includes various apertures, surfaces and ports which cooperate with other features of the invention. Specifically, the positive displacement pump 10 includes an upper or first piston and cylinder assembly 14A and a lower or second piston and cylinder 14B. The upper piston and cylinder assembly 14A and the lower piston and cylinder assembly 14B are substantially identical and the upper piston and cylinder assembly 14A includes a first preferably rectangular piston 16A disposed within a complementary first rectangular cylinder 18A defined by a first rectangular cylinder wall 20A.

The piston 16A includes a first clevis 22A which receives a connecting rod 24A which is pinned to the clevis by a retaining pin 26A. The first connecting rod 24A is in turn pivotally received on a first eccentric crank 32A of an first crankshaft 34A. The first crankshaft 34A includes a pair of counterbalance members 36A which receive opposite ends of the crank 32A. The first crankshaft 34A is supported for a rotation in a plurality of first bearings 38A which may be either standard journal bearings or anti-friction devices such as ball bearing assemblies (not illustrated). Secured to the top of the crankshaft 34A is a first circular cam 42A. The crankshaft 34A is driven by a prime mover such as a variable speed electric motor 46 which is supported by and attached to the housing 12 by a mounting yoke 48.

The lower or second piston and cylinder assembly 14A is in all mechanical respects the same as the upper piston and cylinder assembly 14A except that it operates 180° out of phase with the first or upper piston and cylinder assembly 14A. Thus, it includes a second piston 16B, a second cylinder 18B, a second cylinder wall 20B, a second clevis 22B, a second connecting rod 24B, a second retaining pin 26B, a second crank 32B, a second crankshaft 34B, second counterbalance members 36B, second bearings 38B and a second circular cam 42B. It will be appreciated that the first crank 32A and the second crank 32B are arranged 180° out of phase from one another as illustrated in FIG. 2.

Figure 5:
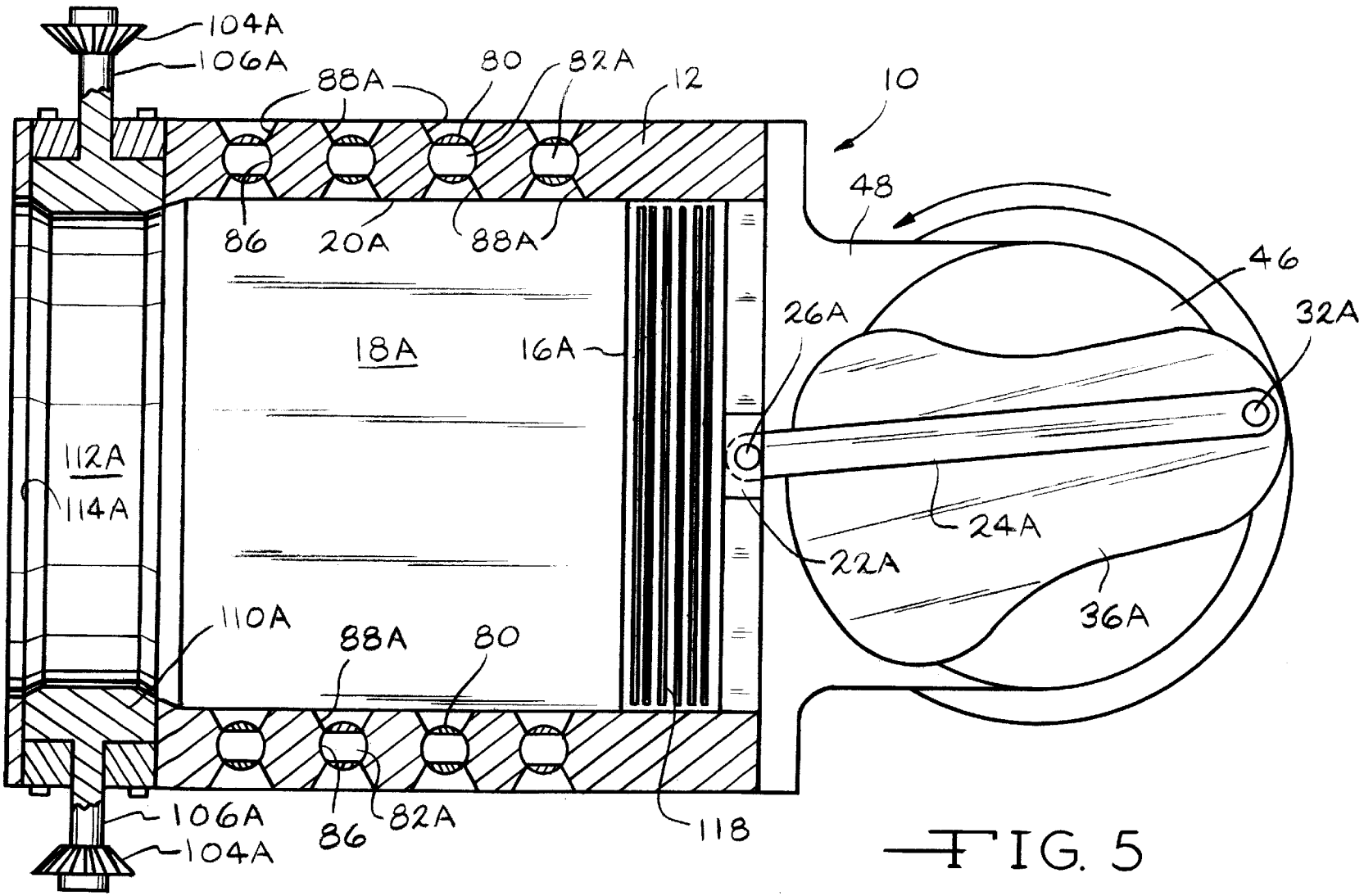
FIG. 5 is a full, sectional view of a positive displacement pump according to the present invention taken along line 5—5 of FIG. 2.

Turning now to FIGS. 1, 2 and 5, each of the first and second piston and cylinder assemblies 14A and 14B includes a respective valve drive assembly 50A and 50B. The upper or first valve drive assembly 50A is disposed on the top of the housing 12 as illustrated in FIG. 1 and the lower or second valve drive assembly 50B is disposed on the bottom of the housing 12 as illustrated in FIG. 2. Once again, the upper or first valve drive assembly 50A and the lower or second valve drive assembly 50B, but for their locations and the fact that the valves open and close in proper relationship with their associated pistons 16A and 16B which are 180° out of phase from one another, are mechanically identical. Hence, only the upper or first valve drive assembly 50A will be fully described, it being understood that the same description applies to the lower or second valve drive assembly 50B.

The first circular cam 42A includes a cam profile or track 52A having a first or high dwell region 54A coupled to a second or low dwell region 56A by a relatively steep or rapid rise region 58A and relatively steep or rapid descent region 60A. Disposed within the cam track 52 is a cam follower 62A which is secured to a reciprocating drive member 64A. The drive member 64A is supported in a suitable spaced-apart pair of journal or anti-friction bearing assemblies 66A which are disposed upon the housing 12 and support the member 64A for reciprocation along its axis. The drive member 64A is pinned to a drive frame 68A by a suitable connecting pin 72A. The drive frame 68A includes a pair of spaced-apart gear racks 74A each consisting of a plurality of spur gear teeth along the outer faces of the drive frame 68A extending parallel to its direction of motion and the drive member 64A. Engaging the gear racks 74A on both faces of the drive frame 68A at multiple locations are a plurality of spur gears 76A. It will be appreciated that at the bottom of the high volume, positive displacement pump 10 are disposed a second circular cam 42B having a cam track 52B as described above, a cam follower 62B, a reciprocating drive member 64B, bearing assemblies 66B and a second drive frame 68B having spaced apart gear racks (not illustrated).

Figure 3:
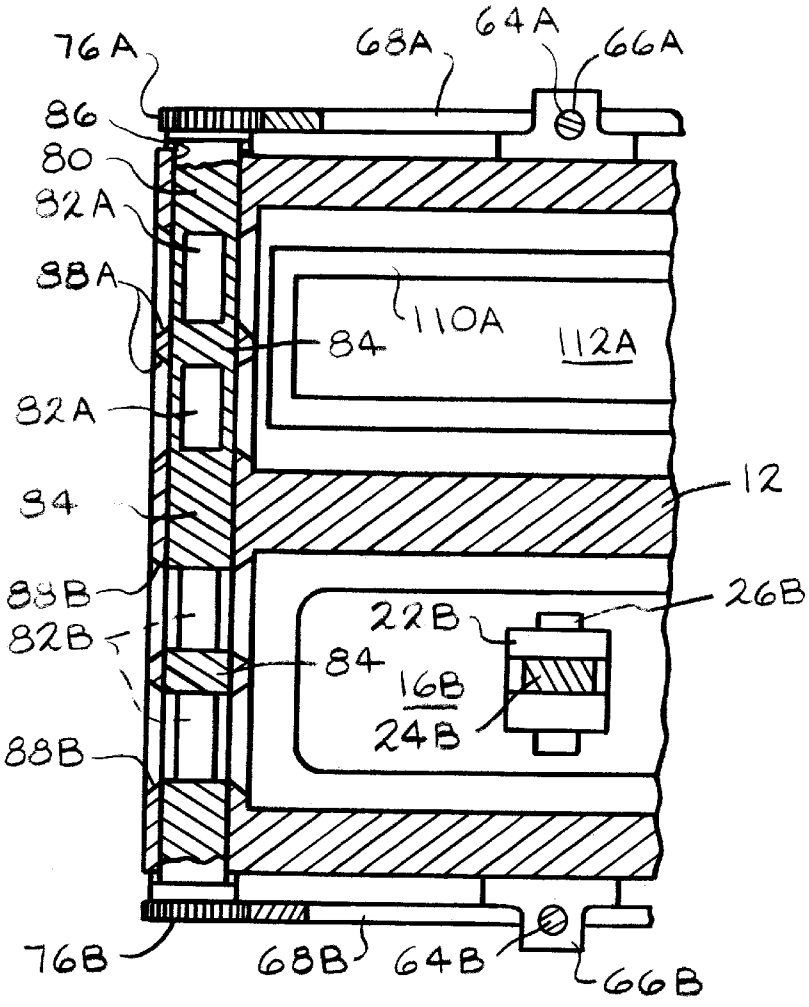
FIG. 3 is a fragmentary, sectional view of an inlet valve and a portion of a positive displacement pump according to the present invention taken along line 3—3 of FIG. 1.

As illustrated in FIGS. 2 and 3, each of the spur gears 76A is associated with a corresponding spur gear 76B which is a component of the lower or second valve drive assembly 50B. Cooperatively, each of the spur gears 76A and 76B disposed along each of the drive frames 68A and 68B bi-directionally drive and rotate a plurality of rotary valve bodies 80. Preferably, there are at least eight rotary inlet valve bodies 80, four on each side of the piston and cylinder assemblies 14A and 14B, although more or fewer may be readily utilized in a given positive displacement pump 10. Each of the rotary inlet valve bodies 80 includes a first pair of preferably rectangular through ports 82A and a second equal sized pair of rectangular ports 82B oriented at an angle of 90°to the ports 82A. Solid portions 84 within the inlet valve body 80 serve to stiffen and strengthen it. The inlet valve bodies 80 are received within circular passageways 86 within the sidewalls 20A and 20B of the housing 12 and includes through ports 88A and 88B which provides communication from the exterior of the housing 12 into the respective cylinders 18A and 18B.

The rise region 58A and the descent region 60A of the cam track 52 are sized to cause bi-directional translation of the drive frame 60A sufficient to rotate each of the spur gears 76A and 76B exactly 900 such that such rotation bi-directionally rotates each of the valve bodies 80 from a first position wherein the rectangular passageways 82A in the upper portion of the valve body provide communication to a second position closing off the inlet ports 88 while simultaneously, the rectangular passageways 82B move from a first position where communication is closed to a second position providing fluid communication to the cylinder 18B. It will be appreciated that all of the valve bodies 80 rotate in unison to provide the aforementioned fluid flow or communication and inhibition of such fluid flow and that such communication and inhibition is 180° out of phase relative to the two piston and cylinder assemblies 14A and 14B.

Figure 4:
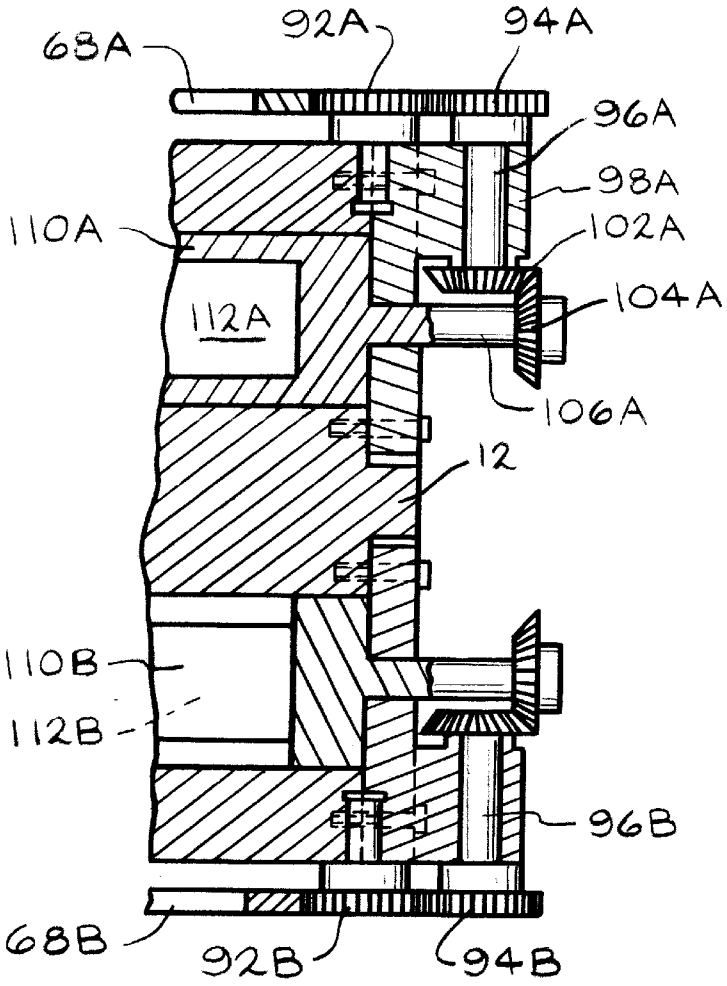
FIG. 4 is a fragmentary, sectional view of outlet valves and a portion of a positive displacement pump according to the present invention taken along line 4—4 of FIG. 1.

Turning now to FIGS. 1, 2 and 4, a final pair of upper spur gears 92A and a final pair of lower spur gears 92B engage the gear rack 74A of the drive frame 68A and the gear rack 74B of the drive frame 68B, respectively. The spur gears 92A and 92B are identical in size and thus rotational characteristics relative to the spur gears 76A and 76B and thus also rotate 90° in response to the reciprocating travel of the drive frames 68A and 68B. The spur gears 92A and 92B mesh with spur gears 94A and 94B, respectively, of the same size and thus effect corresponding rotation thereof. The spur gear 94A is secured to a stub shaft 96A which is supported by a journal bearing 98A. At the end of the stub shaft 96A opposite the spur gear 94A is a bevel gear 102A. The bevel gear 102A meshes with a second bevel gear 104A of equal size and is secured to a stub drive shaft 106A. Accordingly, the stub drive shaft 106A rotates in synchronism and the same 900 of oscillation as the spur gear 92A and the spur gears 76A. The stub shaft 106A is coupled to or is an extension of a first or upper rotary outlet valve body 110A.

The upper rotary outlet valve body 110A includes a through rectangular passageway 112A which extends substantially across the full end face of the piston 16A. In a first position illustrated in FIG. 2, the upper valve body 110A, or more properly the rectangular passageway 112A, provides fluid communication from the interior of the cylinder 18A to an outlet passageway 114A and, in a second position, as illustrated with regard to the second rotary outlet valve body 110B, closes off the outlet passageway 114B. Once again, the lower piston and cylinder assembly 14B includes an identical rotary valve body 110B having a passageway 112B which communicates with an outlet passageway 114B. Here, again the difference is only operational in that the valve bodies 110A and 110B always rotate out of phase to one another.

It should be noted that, as illustrated in FIG. 5, the pistons 16A and 16B include labyrinth seals 118 about their peripheries. Such labyrinth seals 118 may take the form of a plurality of adjacent lands and recesses which extend around the pistons 16A and 16B.

Figure 6:
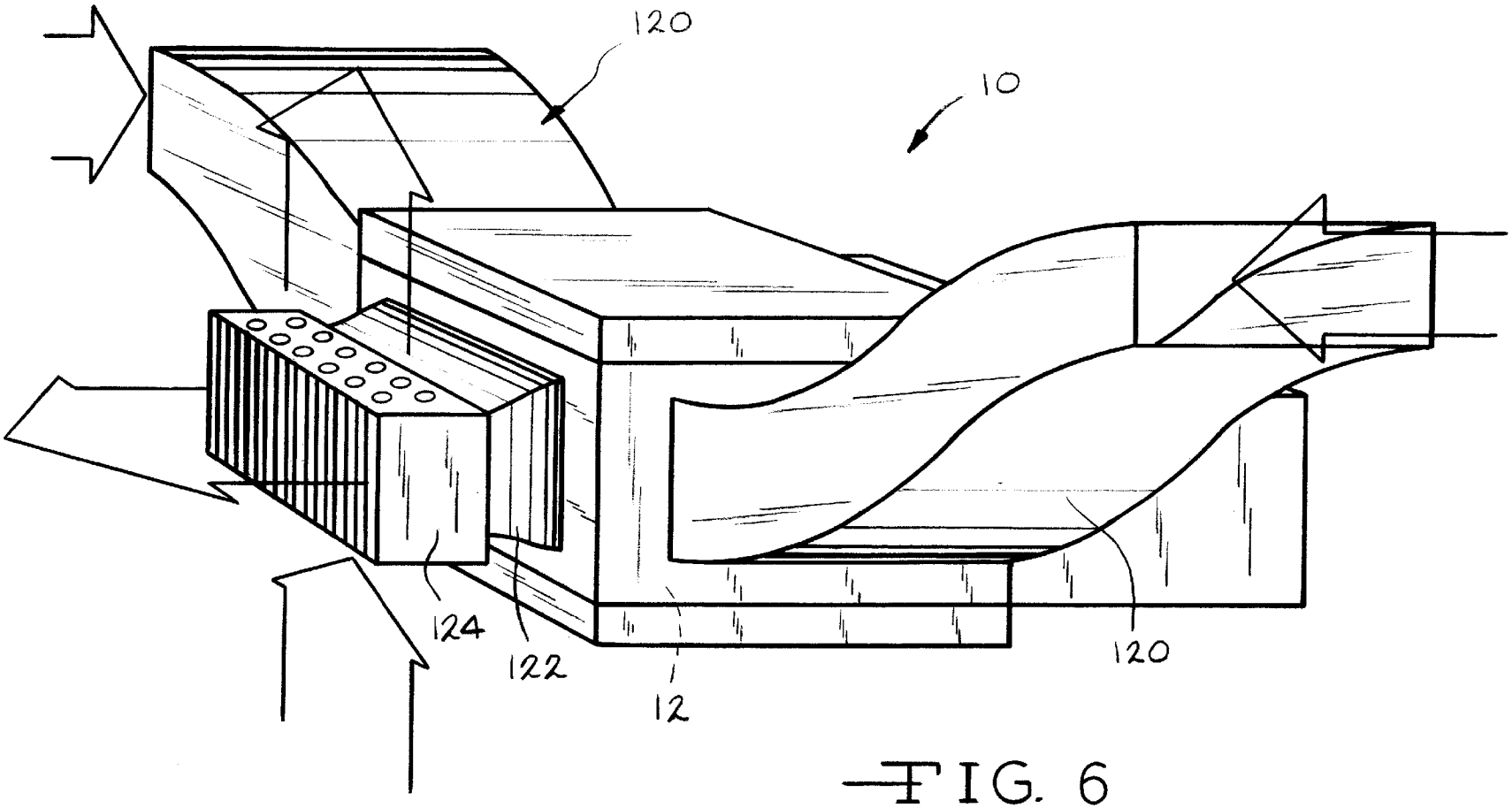
FIG. 6 is a diagrammatic view of a positive displacement pump in an HVAC application.

Referring now to FIG. 6, a typical HVAC installation of a high volume, positive displacement pump 10 according to the present invention is illustrated. Attached to the left and right sidewalls of the housing 12 of the pump 10 are ducts or plenums 120 which supply air to the pump 10 in conventional fashion. Attached to the end face of the housing 12 such that the outlet ports 114A and 114B merge and communicate with it is an outlet duct 122. The outlet duct 122 is coupled to, for example, a heat exchanger 124 through which hot or cold media flows in cross-wise or transverse, isolated passageways. Additional plenum or ducting (not illustrated) communicates with an air distribution system in a building, as will be readily understood, and carries the conditioned air thereto.

As shown in FIGS. 1 and 2, a positive displacement pump 10 according to the present invention will include an upper piston and cylinder assembly 14A and a lower piston and cylinder assembly 14B whose pistons 16A and 16B operate 180° out of phase. The two passageways 114A and 114B typically deliver fluid to a common outlet. This means that the outflow may be characterized as a d.c. level with a superimposed fluctuation that can be described as (for the first cycle)

$$q_{net}\int_0^T = q_u\int_0^{T/2} + q_e\int_{T/2}^T \tag{1}$$

where T is the reciprocal of the driving frequency (fd) and $$\omega = f_d/2\pi. \tag{2}$$

Turning then to the operation of the pump, as suggested by equation (1), the upper passageway 114A will deliver the fluid to be pumped for the time period $nT \leqq t < (2n+1)T/2$ and the lower passageway 114B will deliver fluid during the period $(2n+1)T/2 \leqq t < (n+1)T$. This delivery is powered by the forward advance of the respective pistons 16A and 16B and it is controlled by the angular position ($\phi$) of the rotary outlet valves 110A and 110B illustrated in FIG. 1.

It is assumed, for the present discussion, that $\theta_1(t)$ is the linear function:

$$\theta_1(t) = \omega t \tag{3}$$

and that $\omega$=constant.

The magnitude of the volume flow rate will be linearly proportional to $\omega$ given the condition that the inlet ports 88A and 88B are fully filled from the surrounding plenum 120 on each stroke. Given the inertia of the elements involved, the change in flow rate that results from a change in the rotational speed ($\omega$) of the crankshaft 34A is considered to represent a "slow" change of the operating condition.

Industrial Application —HVAC Systems

An application for the positive displacement pump 10 is that of air delivery to the heating/cooling coils of an HVAC system. Of concern for such a system is the upstream propagation of flow noise.

This concern suggests that the forward (pressurizing) stroke of the pistons 16A and 16B be executed relatively faster than the filling (return) stroke. Various mechanical linkages which can execute such drive patterns exist.

A concomitant advantage of this mode of operation is that the velocity of air through the heating/cooling coils will be larger than would be the velocity in a symmetric-drive pattern. Specifically, the larger the velocity, the greater will be the momentary heat transfer and the greater will be the time averaged heat transfer for a given area of the heat exchanger 124. This benefit is in addition to the intrinsic benefit of the positive displacement pump 10 according to the present invention for such heat transfer applications. Specifically, by creating twice the cycle average velocity over one-half of the heat exchanger for one-half of the cycle time, and repeating this behavior for the other one-half of the heat exchanger for one-half of the cycle time, a greater heat transfer will be obtained as enhanced heat transfer will derive from both the larger temperature differences and the larger convection heat transfer properties of the higher speed flow.

The foregoing disclosure is the best mode devised by the inventor for practicing this invention. It is apparent, however, that methods incorporating modifications and variations will be obvious to one skilled in the art of positive displacement pumps. Inasmuch as the foregoing disclosure presents the best mode contemplated by the inventor for carrying out the invention and is intended to enable any person skilled in the pertinent art to practice this invention, it should not be construed to be limited thereby but should be construed to include such aforementioned obvious variations and be limited only by the spirit and scope of the following claims.

I claim:

1. A positive displacement pump comprising, in combination.

a pair of cylinders disposed in parallel each having a sidewall and a head, a pair of pistons received in a respective one of said pair of cylinders, a crankshaft having a pair of cranks for driving a respective one of said pair of pistons, a plurality of rotary inlet valves disposed adjacent said cylinder sidewalls, said inlet valves having at least a first port and a second port oriented at 90° to said first port, a cam, a follower acted upon by said cam and a drive linkage operably disposed between said first follower and said plurality of rotary inlet valves, and a pair of rotary outlet valves disposed adjacent a respective one of said pair of cylinder heads in fluid communication with a respective one of said cylinder.

2. The positive displacement pump of claim 1 wherein said pair of cranks are disposed in diametric opposition.

3. The positive displacement pump of claim 1 further including a drive motor operably coupled to said rotary inlet valves, said rotary outlet valves and said crankshaft.

4. The positive displacement pump of claim 3 further including a bevel gear drive having an input driven by said drive motor and an output driving at least one of said outlet valves.

5. The positive displacement pump of claim 1 wherein said pistons are rectangular.

6. The positive displacement pump of claim 1 wherein said drive linkage includes a gear rack and a plurality of spur gears coupled to a respective one of said plurality of rotary inlet valves and engaging said gear rack.

7. The positive displacement pump of claim 1 wherein said drive linkage includes a gear rack and a pair of spur gears operably coupled to a respective one of said pair of rotary outlet valves.

8. A positive displacement pump comprising, in combination, a drive motor, a pair of cylinders each having a sidewall and an end, a piston received in each of said pair of cylinders, a crankshaft driven by said drive motor and having a pair of cranks for driving a respective one of said pair of pistons, a plurality of rotary inlet valves associated with said pair of cylinder sidewalls, said rotary inlet valves including an elongate cylindrical member having at least two transverse passageways, a cam, a follower acted upon by said cam and a drive linkage operably disposed between said first follower and said plurality of rotary inlet valves, and a rotary outlet valve disposed adjacent each of said pair of cylinder heads.

9. The positive displacement pump of claim 8 wherein said drive motor is operably coupled to said rotary inlet valves and said rotary outlet valves and drives said valves in synchronism.

10. The positive displacement pump of claim 8 wherein said drive linkage includes a gear rack and a plurality of spur gears coupled to a respective one of said plurality of rotary inlet valves and engaging said gear rack.

11. The positive displacement pump of claim 8 wherein said drive linkage includes a gear rack and a pair of spur gears operably coupled to a respective one of said pair of rotary outlet valves.

12. The positive displacement pump of claim 8 wherein at least two transverse passageways are oriented at 90° to one another.

13. A positive displacement pump, comprising, in combination a housing defining a pair of cylinders having sidewalls and ends, a piston received in each of said cylinders, a crankshaft defining a pair of diametrically opposed cranks, one of said cranks operably coupled to a respective one of said pistons, a plurality of rotary inlet valves disposed adjacent said cylinder sidewall between a plenum and said cylinder said rotary inlet valves defining elongate cylindrical members having two ports defined thereby, one of said two ports associated with each of said paid of cylinders and, a rotary outlet valve associated with each of said cylinders and disposed adjacent said cylinder end, and a drive assembly for providing energy to said crankshaft and said rotary inlet valves and said rotary outlet valves, said drive assembly including a gear rack and a plurality of spur gears, each of said plurality of spur gears coupled to a respective one of said plurality of rotary inlet valves and engaging said gear rack.

14. The positive displacement to pump of claim 13 wherein said rotary inlet valve ports are oriented at 90° to one another.

15. The positive displacement pump of claim 13 wherein said drive assembly includes a cam and a cam follower driving said valves and a drive motor operably coupled to said piston and a said cam.

16. The positive displacement pump of claim 13 wherein said pistons are rectangular and include labyrinth seals about their peripheries.

17. A positive displacement pump, comprising, in combination, a housing defining a pair of cylinders having sidewalls and ends, a piston received in each of said cylinders, each of said pistons being rectangular and including labyrinth seals about their peripheries, a crankshaft defining a pair of diametrically opposed cranks, one of said cranks operably coupled to a respective one of said pistons a plurality of rotary inlet valves disposed adjacent said cylinder sidewall between a plenum and said cylinder said rotary inlet valves defining elongate cylindrical members having two ports defined thereby, one of said two ports associated with each of said paid of cylinders and, a rotary outlet valve associated with each of said cylinders and disposed adjacent said cylinder end, and a drive assembly for providing energy to said crankshaft and said rotary inlet valves and said rotary outlet valves.

18. The positive displacement pump of claim 17 wherein said drive assembly includes a gear rack and a plurality of spur gears, each of said plurality of spur gears coupled to a respective one of said plurality of rotary inlet valves and engaging said gear rack.

19. The positive displacement pump of claim 17 wherein said drive assembly includes a cam and a cam follower driving said valves and a drive motor operably coupled to said piston and a said cam.

* * * * *